US006158855A

United States Patent [19]

Saikawa

[11] Patent Number: 6,158,855

[45] **Date of Patent: *Dec. 12, 2000**

[54] INK JET HEAD AND INK JET RECORDING APPARATUS HAVING SAME

[75] Inventor: Hideo Saikawa, Machida, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,725

[22] Filed: Aug. 29, 1997

Related U.S. Application Data

[63] Continuation of application No. 08/300,530, Sep. 6, 1994, abandoned.

[30] Foreign Application Priority Data

Sep. 3, 1993 [JP] Japan ..... 5-219457
Aug. 8, 1994 [JP] Japan ..... 6-185746

[51] Int. Cl.[7] ..... B41J 2/175

[52] U.S. Cl. ..... 347/93; 347/92

[58] Field of Search ..... 347/85–87, 92, 347/93

[56] References Cited

U.S. PATENT DOCUMENTS

| | | | |
|---|---|---|---|
| 3,708,118 | 1/1973 | Keur | 347/93 |
| 3,929,071 | 12/1975 | Cialone et al. | 101/335 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,689,641 | 8/1987 | Scardovi et al. | 347/93 |
| 4,723,129 | 2/1988 | Endo et al. | 347/56 |
| 4,740,796 | 4/1988 | Endo et al. | 347/56 |
| 5,237,342 | 8/1993 | Saikawa et al. | 347/87 |
| 5,296,875 | 3/1994 | Suda | 347/93 |

FOREIGN PATENT DOCUMENTS

| | | | |
|---|---|---|---|
| 0041777 | 12/1981 | European Pat. Off. . | |
| 0383558 | 8/1990 | European Pat. Off. . | |
| 2737911 | 3/1979 | Germany . | |
| 79174 | 6/1980 | Japan | 347/92 |
| 59-123670 | 7/1984 | Japan . | |
| 59-138461 | 8/1984 | Japan . | |
| 198254 | 10/1985 | Japan | 347/93 |
| 234848 | 11/1985 | Japan | 347/93 |
| 61-173945 | 8/1986 | Japan . | |
| 62-257857 | 11/1987 | Japan . | |
| 1324 | 1/1990 | Japan | 347/93 |
| 4-250046 | 9/1992 | Japan | 347/92 |
| 331157 | 11/1992 | Japan | 347/92 |
| 332647 | 11/1992 | Japan | 347/92 |
| 84923 | 4/1993 | Japan | 347/92 |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet head for ejecting ink includes an ink passage for supplying ink from an ink container for containing ink; a filter chamber in the ink passage, the filter chamber containing therein a filter; wherein the chamber has a cross-sectional area larger than that of the ink passage, and is provided with an inlet opening in fluid communication with an inlet part of the ink supply passage for supplying the ink from the ink container to the filter chamber and an outlet opening in fluid communication with an outlet part of the ink passage for supplying the ink out of the chamber; wherein the inlet opening and outlet opening are faced to a filter with a clearance, and the chamber is provided with bubble moving portion for moving bubbles away from the inlet opening.

18 Claims, 8 Drawing Sheets

INK JET HEAD AND INK JET RECORDING APPARATUS HAVING SAME

This application is a continuation of application Ser. No. 08/300,530, filed Sep. 6, 1994, now abandoned.

FIELD OF THE INVENTION AND RELATED ART

The present invention relates to an ink jet head for ejecting ink to effect recording, and an ink jet recording apparatus provided with the same, more particularly it relates to an ink supply system in an ink jet head.

An ink jet recording apparatus is provided with a recording head (ink jet head) having a plurality of ejection outlets (nozzles) for ejecting the ink. If the ejection outlet is clogged, normal recording is not possible.

An improper ejection due to the clogging at the ejection outlets occurs, for example, due to fine foreign matters introduced from an ink supply system when an ink container for containing ink having porous material to retain the ink therein, is exchanged, due to the foreign matter produced from the recording material or the like directly attached to the ejection side surface of the ink jet head, or due to the high viscosity ink resulting from evaporation of the ink solvent adjacent the ejection outlet when the recording apparatus is kept unused for a long period.

For this reason, the provision of means for removing foreign matters from the ink in a path from an ink accommodator to an ejection outlet, is desirable. A general method therefor is the provision of a filter in the ink supply path to remove the foreign matter.

As a method for preventing the clogging of the ejection outlets due to the external foreign matters, a widely used method is a recovery process in which the ink is sucked through the ink ejection outlet to suck the foreign matters out.

The sucking recovery process is advantageous because it can remove fine bubbles in a common liquid chamber or the like with which the plurality of ejection outlets are in fluid communication, as well as the foreign matters adjacent the ejection outlet. If the bubbles exists in the common liquid chamber or the like, the ejection pressure is undesirably reduced.

When the filter is used, the bubbles in the ink supply path are moved with the supply of the ink from the ink accommodator to the recording head with the ink to the filter, so that they are concentrated on the filter. When the recording head and an ink cartridge is detachably mountable together, the air may be introduced upon the coupling of the recording head and the ink cartridge. The bubbles may be produced by the solved air in the ink by ambient condition change or the like. The bubbles concentrated on the filter may obstruct ink flows through the filter or clogs the filter intermittently to make the ink supply instable. To avoid this, the sucking recovery device for removing the above-described clogging is also utilized as the mechanism for removing the bubbles from the filter.

The ink jet apparatus is used in many fields, and therefore, it is desirable that the ink jet unit comprising the ink jet head or an ink cartridge as an ink accommodator therefor, is made common for the apparatuses in the different fields. An ink jet unit is therefor desirable if the high quality image can be provided irrespective of the position or pose of the ink jet unit without the influence of the bubbles on the filter.

Recently, a high speed recording is desired in the ink jet recording apparatus. For increasing the speed, the amount of ink supply per unit type to the nozzle is to be increased.

In this case, if the cross-sectional area of the filter is the same, the flow rate through the filter increases with the result of increased flow resistance by the filter. As a result, the ink supply would not be enough to meet the ejection cycle of the high speed recording, and therefore, the ink ejection is not proper with the result of deteriorated printing quality.

In order to assure the ink supply to the nozzle upon the high speed recording in a small size ink jet apparatus, the portion having the filter is enlarged beyond the inside diameter of the ink passage to permit use of larger area of the filter, and therefore, to avoid the increase of the ink flow rate per unit area so as to avoid the increase of the flow resistance.

However, the increase of the effective area of the filter to permit the high speed recording, means that the flow rate per unit area is reduced as compared with that in the ink passage for the purpose of suppressing the increase of the flow resistance. Therefore, even if it is proper for the high speed recording, at the time of the bubble removal by the recovery process, the ink flow during the recovery operation is not enough to pass the bubbles through the filter, in other words, the pressure diferences across the filter is not sufficiently applied to the filter portion. As a result, the difficulty arises in removing the bubbles from the filter. Therefore, the air bubbles stagnate in the filter.

In addition, with the above-described structure, the bubbles flow with the ink toward the filter, and therefore, they are caught at the central portion of the filter by the meniscus force. The pressure of the ink flowing through the ink passage is much higher during the recovery process operation as compared with the recording operation. The pressure applied to the bubbles is also high during the recovery processing operation, and therefore, the change of the configuration of the bubbles on the filter is large and complicated.

When the bubbles have a substantially large size, the effective area of the filter reduces with the result of the increased ink flow per unit area during the recovery operation, and therefore, the pressure applied to the bubble is increased. As a result, the pressure applies to the bubbles significantly and locally changes.

Then, only a part of the bubbles is intermittently subjected to a pressure beyond a threshold of passage through the filter with the result of formation of fine bubbles. In addition, the position of the pressure application locally changes because the bubble can be freely deformed, the fine bubbles are further produced. Particularly when the ink flows along the gravity, that is, downwardly, the changes of the bubbles are promoted by the buoyancy so that the production of the fine bubbles is promoted.

When the ink contains surfactant or the like effective to promote the bubble formations, a part of the bubbles stagnating in the filter is easily passed through the filter during the sucking operation with the result of the fine bubbles remaining in the liquid chamber of the recording head. Such fine bubbles in the liquid chamber are adversely influential to the ink ejection.

The fine bubbles can be removed usually by the sucking recovery operation. However, as described above, a part of the bubbles passes through the filter with the result of fine bubble production, and therefore, the removal of the fine bubbles from the liquid chamber is difficult. It would be considered that the bubbles on the filter are removed by using a larger capacity pump for the sucking recovery. However, this results in the bulkiness of the ink jet recording apparatus, against the recent demand.

SUMMARY OF THE INVENTION

Accordingly, it is a principal object of the present invention to provide an ink jet recording head and an ink jet recording apparatus with which a high speed recording is possible without increasing the size of the ink jet recording apparatus with simple and inexpensive manner, and in which the influence of the bubbles stagnating at the filter is minimized.

It is another object of the present invention to provide an ink jet recording head and an ink jet recording apparatus and an ink jet recording method in which the bubbles stagnating at the filter are not reformed into fine bubbles by a recovery process such as sucking.

It is a further object of the present invention to provide an ink jet recording head, an ink jet recording apparatus and an ink jet recording method with which the adverse influence of the bubbles stagnating at the filter is suppressed to permit stabilized ejection, with a plurality of ejecting poses.

According to an aspect of the present invention, there is provided an ink jet head for ejecting ink, comprising: an ink passage for supplying ink from an ink container for containing ink; a filter chamber in the ink passage, the filter chamber containing therein a filter; wherein the chamber has a cross-sectional area larger than that of the ink passage, and is provided with an inlet opening in fluid communication with an inlet part of the ink supply passage for supplying the ink from the ink container to the filter chamber and an outlet opening in fluid communication with an outlet part of the ink passage for supplying the ink out of the chamber; wherein the inlet opening and outlet opening are faced to a filter with a clearance, and the chamber is provided with bubble moving means for moving bubbles away from the inlet opening.

In a second aspect of the present invention, there is provided an ink jet head according to the first aspect, wherein the bubble moving means provides a smallest clearance between the filter and an internal wall of the chamber adjacent the inlet.

In a third aspect of the present invention, there is provided an ink jet head according to the first aspect, wherein the air moving means is in the form of an internal wall surface of the chamber having a better wettability adjacent the inlet opening than a portion away therefrom.

In a fourth aspect of the present invention, there is provided an ink jet head according to the first aspect, wherein the air moving means is in the form of an internal wall surface of the chamber or the filter inclined relative to a horizontal, plane.

In a fifth aspect of the present invention, there is provided an ink jet recording apparatus, comprising: an ink jet head for ejecting ink; an ink passage for supplying ink from an ink container for containing ink; a filter chamber in the ink passage, the filter chamber containing therein a filter; wherein the chamber has a cross-sectional area larger than that of the ink passage, and is provided with an inlet opening in fluid communication with an inlet part of the ink supply passage for supplying the ink from the ink container to the filter chamber and an outlet opening in fluid communication with an outlet part of the ink passage for supplying the ink out of the chamber; wherein the inlet opening and outlet opening are faced to a filter with a clearance, and the chamber is provided with bubble moving means for moving bubbles away from the inlet opening.

According to an aspect of the present invention, the bubbles stagnating at the filter moves toward the marginal portions in a chamber where the filter is provided, and therefore, the obstruct against the ink flow from the ink container can be prevented.

In an aspect of the present invention, the influence of the variation of the ink supply pressure due to the configuration or the like of the ink passage can be minimized.

Therefore, the formation of the fine bubbles at the filter can be reduced.

Therefore, a high quality image recording is possible at all times without reduction of the ink supply performance resulting from the variation of the ink supply amount, in a high speed recording.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
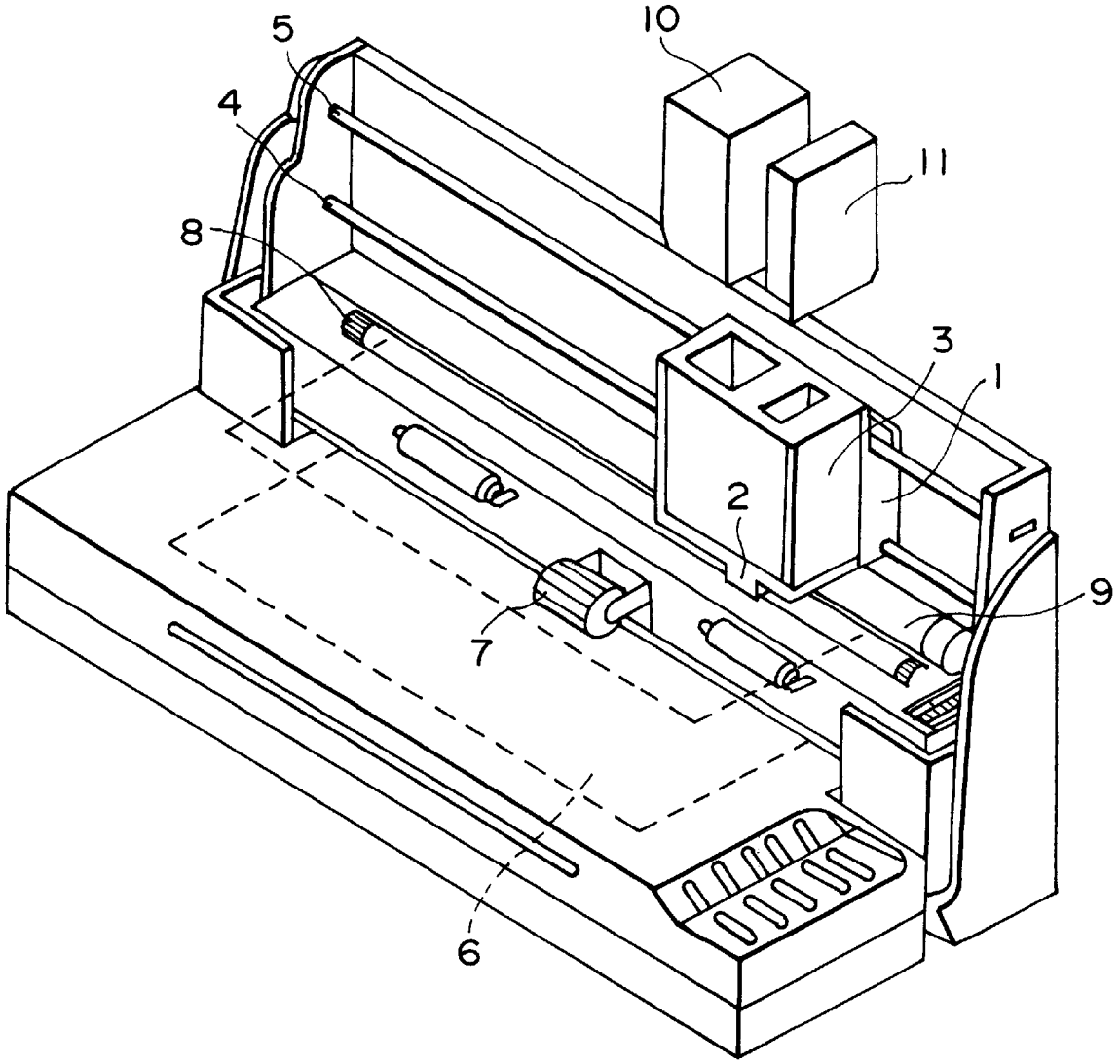
FIG. 1 is a perspective view of an exemplary ink jet recording apparatus to which the present invention is applicable.

Referring to FIG. 1, there is shown an example of an ink jet recording apparatus to which the present invention is applicable. In FIG. 1, designated by reference numeral 1 is a carriage; 2, a recording head (ink jet head); and 3, container guide. The ink jet head and the container guide 3 are mounted on a carriage 1. To the container guide 3, a color ink container 10 and a black ink container 11 (ink accommodators) are mounted to supply the ink to the ink jet head 2.

The ink container is detachably mountable on the container guide 3, and are replaceable independently in accordance with the respective ink consumptions. In this embodiment, the color ink container 10 has a casing and cyan, magenta, yellow containers therein. The ink chambers are separated by partition walls to isolatedly accommodate the respective inks.

Designated by reference numeral 4 is a lead screws interrelated with an unshown carriage motor; 5, a guide shaft. The carriage 1 translate on the guide shaft 5 by the lead screw 4 to scan the recording head over the recording material.

During the recording operation, the ink is ejected in the direction of the gravity, that is, downwardly, from the ink jet head 2. The ejected ink is received by the recording sheet 6 disposed faced to the ink ejection parts of the ink jet head 2, so that an image is formed. The downward ink ejection is preferable from the standpoint of the high speed recording because it promotes the ink supply to the ink jet head after the ink ejection. The recording sheet 6 is discharged in interrelation with the printing action by a feeding roller 7, a discharging roller 8 and a sheet confining plate 9.

Figure 2:
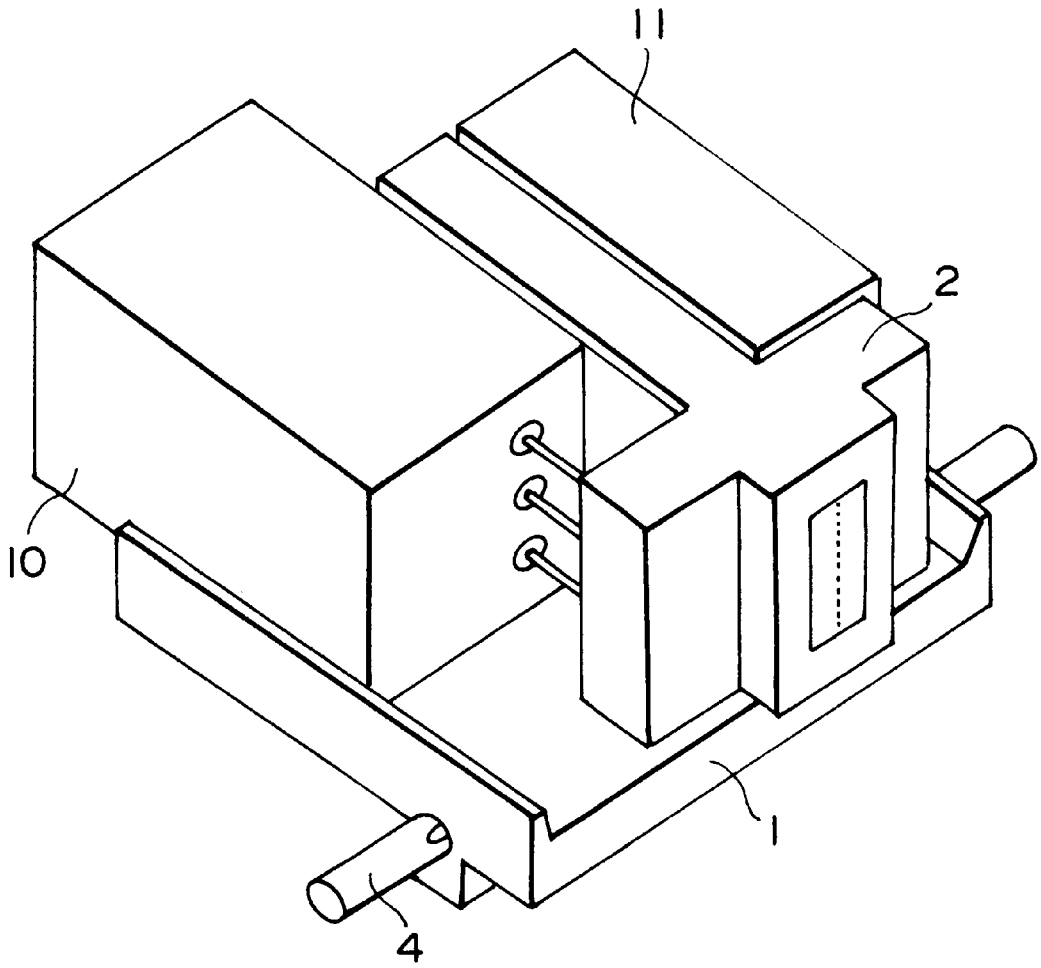
FIG. 2 is an enlarged perspective view of a carriage of an ink jet recording apparatus shown in FIG. 1.

FIG. 2 is an enlarged perspective view of the carriage 1 shown in FIG. 1, in which the container guide 3 has been removed from the carriage 1. The color ink container 10 and the black ink container 12 are mounted from a rear side which is opposite from the ejection side of the ink jet head 2.

FIG. 3 is a perspective view of an ink jet head of FIG. 2. In FIG. 3, (*a*), the ink jet head is shown as seen from an ink inlet side to the recording head (pipe side), that is, as seen from the ink container insertion side, and FIG. 3, (*b*) is a perspective view as seen from the ejection side.

In FIG. 3, (*a*), designated by a reference numeral 201 is a silicon substrate on which heater or the like for the ink ejection is formed; and 202, a print board including a driving circuit for the ink jet head 2. Reference numeral 203 designates an aluminum plate supporting the silicon substrate 201, the print board 202; 204, 205 and 206, ink supply pipes for supplying the yellow, cyan and magenta inks from the color ink container 10 to the ejecting parts of the respective colors through a unit 208.

In FIG. 3, (*b*), designated by 2Y, 2M, 2C and 2BK are groups of nozzles (ejection outlets) for ejecting yellow, cyan, magenta and black inks, respectively. In the ink jet recording head 2, the respective color nozzles are arranged on the respective lines.

Designated by a reference numeral 207 is an ink pipe for introducing the ink from the black ink container 11, and is disposed across the aluminum plate 203 from the ink pipe for the color ink, shown in FIG. 3, (*a*).

Embodiment 1

Figure 4:
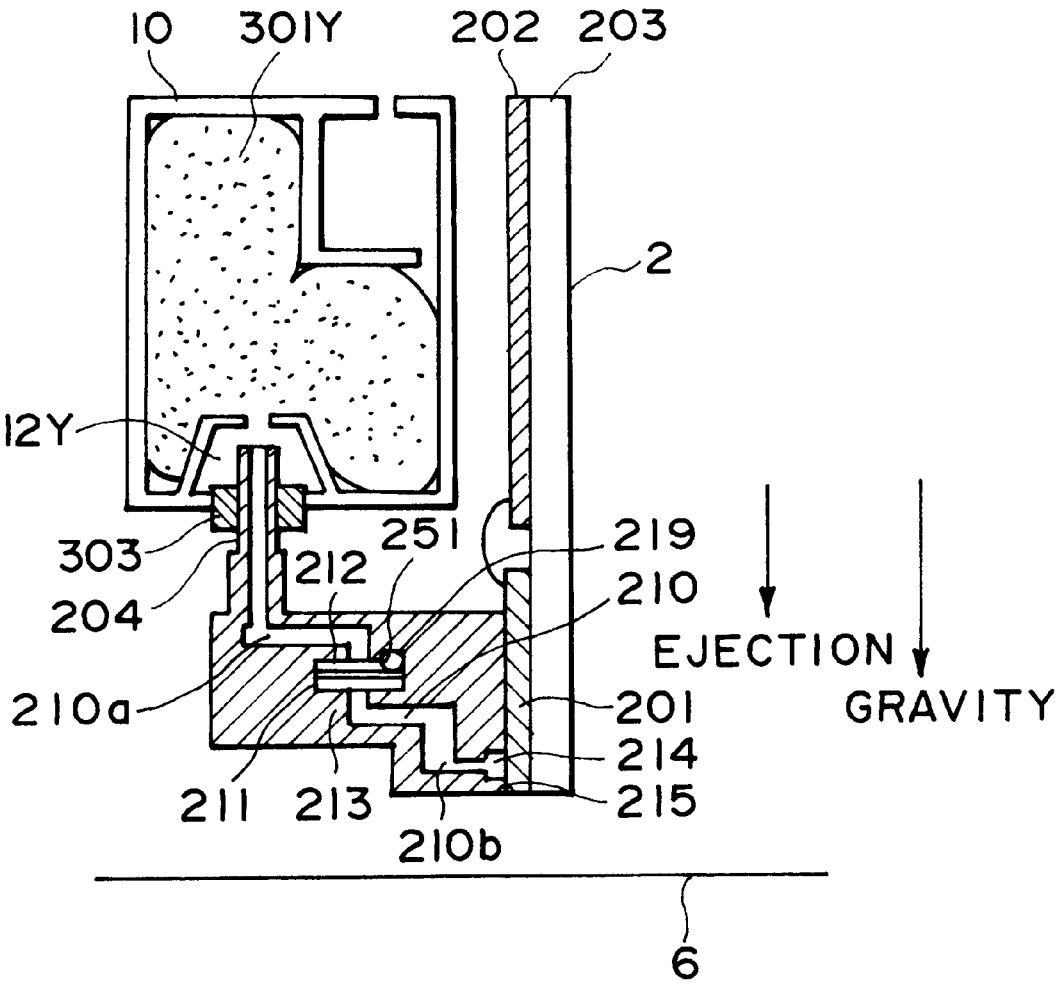
FIG. 4 is a sectional view of an ink jet recording apparatus according to a first embodiment of the present invention, and illustrates an ink supply system from an inside of the ink container or an ink accommodator to an end of the nozzles of the ink jet head.

Referring to FIG. 4, a first embodiment is illustrated, in which an ink jet head 2 and a color ink container 10 are connected. A color ink supply system shown in FIG. 4 comprises an ink container for containing the yellow ink, an ink passage for the ink and ink ejection part and so on. Along the ink supply path, the cross-sections are shown. Basically the same structure is used for the other color ink supply system (black, magenta, cyan).

In FIG. 4, the silicon substrate 201 has energy generating elements (not shown), and the nozzles 215 are at the ends of the ink passages containing the energy generating elements. The ink 12 is ejected to the recording sheet 6 by the energy generated by the energy generating element, from the nozzle 215. Thereafter, the ink is supplied to the ink passage from the ink container.

In the color ink container 10, there is an ink absorbing material 301Y for retaining the ink, the absorbing material being of porous material or the like. By the capillary force provided by the ink meniscuses formed in the pores of the ink absorbing material 301Y, the pressure of the ink in the nozzle 215 is maintained at a static negative pressure.

The negative pressure is a back pressure against the ink supply to the ejection part of the ink ejecting head. It means a static pressure lower than the ambient pressure at the ejection part. In this embodiment, it is approx. −50 Pa relative to the ambient pressure at the ejection part. Hereinafter, this is called "negative pressure state".

The ink is retained in the ink absorbing material 301. A sealing member 303 of an elastic material is in the form of a rubber plug.

When the ink container is mounted to the ink jet head, as shown in FIG. 4, the sealing member 303 at the bottom of the ink container 10 is penetrated through a pipe 204 at and of the supply unit 208, by which the ink can be supplied to the ink jet head from the ink absorbing material in the ink container.

Since the sealing member 303 is used, the sealing can be maintained when the pipe 204 of the supply unit 208 needles, so that the electric contact or the like are not contaminated.

The supply unit 208 is provided with an ink supply passage 210 for fluid communication with the nozzle 215 and the pipe 204 coupled with the sealing member 303 of the color ink container 10.

In the ink supply passage 210, there is provided a filter chamber (filter box) 211 having therein a stainless steel filter 213 as a nozzle clogging preventing means by trapping foreign matters in the ink.

The filter box 211 has a cross-sectional area larger than the ink supply passage 210. Therefore, the flow rate per unit area through the filter is made smaller than the flow rate per unit area in the ink passage to prevent adverse influence of the pressure drop by the filter to the ink supply function even if the ink flow rate is increased due to the high speed recording.

The filter 213 in the filter box 211 is disposed, crossing the ink flow line, and substantially divides the filter box 211 into equal two parts.

For the purpose of simplicity of explanation, the ink supply passage 210 is assumed to be constituted by an ink passage 210*a* for fluid communication between the ink pipe 204 and the filter box 210, and an ink passage 210*b* for fluid communication between the filter box 211 and the nozzle 215.

With this structure, as described hereinbefore, the bubbles introduced through between the ink container 10 and the pipe 204 upon the ink container exchange, or the bubbles resulting from the solved gases, enter the ink supply passage 210*a*, and the bubbles can be concentrated on the filter in accordance with the ink supply to the ink jet head.

In this embodiment, in order to remove the bubbles concentrated on the filter, the sucking recovery mechanism for removing the clogging is used, but the sucking capacity is 60 kPa of the peak sucking pressure, and 300 $mm^3$ of the sucking quantity (total of yellow, magenta, cyan and black inks).

The filter 213 has a mesh of 8 $\mu$m of the effective transmission size and 44 $mm^2$ of the cross-sectional area. The pressure drop between the filter 213 to the nozzle is approx. 75%, and the pressure difference across the filter 213 is approx. 15 kPa.

When this mesh of the filter 213 is used, the minimum threshold pressure for transmittance of the bubbles is approx. 18 kPa. Therefore, the bubbles do not pass through the filter during the normal recovery operation. The bubbles are permitted to pass through the filter only when the filter 213 is closed by the deposition of bubbles with the result that the effective area so reduces and the ink flow rate per unit area so increases that the pressure difference exceeds 18 kPa. Assuming that there is no variation of the pressure of the ink supply passage, the 18 kPa pressure is reached, when the bubbles cover ⅙ of the effective filtering area. Therefore, the formation of the fine bubbles upon the recovery operation in this embodiment occurs most when the bubbles cover more than ⅙ of the filter. The description will be made as to the detailed structure of the filter for suppressing instability of the ink supply performance attributable to the fine bubbles.

Since the ink has a substantial viscosity, the pressure applied to the bubbles stagnating in the filter (pressure difference across the filter) is highest on a line connecting the inlet port and the outlet port. In this embodiment, the structure is such that the bubbles are removed from the line.

FIG. 5 is an enlarged sectional view of the filter box 211 in the embodiment of FIG. 4. As described hereinbefore, the ink supply passage 210*a* introduces the ink from the ink container into the filter box through the inlet port 216. The ink is filtered by the filter 213, and flows into the ink passage 210*b* in fluid communication with the nozzle through the outlet port 217. In this embodiment, the filter box is so disposed that the ink flow is codirectional with the gravity.

As shown in FIG. 5, (*a*), a recess 219 is formed on an inner wall 212 having the inlet port 216 which is in the ink container 10 side of the filter box 211. The recess is formed at a position most remote from the inlet port of the filter box. Therefore, the distance between the inner wall surface and the filter 213 is enlarged by the recess.

In FIG. 5, (*a*), the recess is formed at a part of the marginal area. The recess 219 may be formed covering the entire marginal area, as shown in FIG. 5, (*b*).

With the structures of FIGS. 5, (*a*) and (*b*), even if the bubbles enter the ink supply passage upon the ink container exchange with the result that the ink stagnates in the neighborhood of the inlet opening of the filter box in accordance with the supply of the ink to the nozzle, the bubbles move toward a position where the distance between the filter 213 and the filter box is large, because of the buoyancy of the bubbles and the surface tension pending to reform the bubbles into light spherical form.

Therefore, by the provision of the recess 219 at the marginal area, the bubbles stagnate with stability away from the opening. In this case, the flow of the ink for the ink supply during the recovery operation, against the bubbles, is in the direction crossing with the direction of the buoyancy, as contrasted to the case that the bubbles are on the line connecting the inlet port and the outlet port.

For these reasons, the deformation of the bubbles as in the case where the bubbles exist in the central area of the filter, does not occur, but at least a part of the bubbles existing between the filter 213 and the internal wall surface having the inlet port, passes through the filter 213 without formation of fine bubbles. Additionally, the bubbles remaining in the filter box 211 are positioned at the marginal area, and therefore, the ink flow during the normal recording operation is not impeded.

In this embodiment, the structure of the recess at the marginal area in the inner wall surface having the inlet port function as bubble moving means for introducing the bubbles to the marginal area.

FIG. 5, (*c*) is a modification of this embodiment, wherein the inner wall surface 222 having the inlet port 216 is so inclined that the space from the filter 213 increases toward the marginal area. The distance from the filter is the maximum at the most remote position from the inlet port. In other words, the internal wall surface extends inclinedly relative to a horizontal direction perpendicular to the direction of the gravity, so that the neighborhood of the inlet port is the lowest on the basis of the direction of the gravity. In this modification, the bubbles concentrated adjacent the opening are more easily movable than the foregoing embodiment.

As shown in FIGS. 5, (*a*), (*b*) and (*c*), by expanding the gap between the filter 213 and the internal wall at the marginal area from the gap between the inlet port and the filter 213, the bubbles stagnating at the central portion of the filter can be moved to the position where the action of the pressure produced by the ink flow during the recording operation or the sucking recovery operation is not so strong, and therefore, the local increase of the pressure acting on the bubbles and the variations of the acting positions due to the cooperation with the buoyancy of the bubbles as in the central portion of the filter, are reduced, so that the production of the fine bubbles can be prevented.

Even if the bubbles are concentrated during the recording operation or the like, the bubbles grow up at the marginal area, and therefore, it can be avoided that the bubbles plug the inlet port 216 of the filter box or that the ink supply to the nozzle changes, before the bubbles are permitted to pass through the filter by the pressure during the sucking recovery process.

Even if the direction of the ink ejection is not vertical (coaxial with the direction of the gravity), more particularly, even if it is in the horizontal direction crossing with the gravity direction, the movement of the bubbles forming the meniscus on the filter, can be promoted.

As shown in FIGS. 5, (*b*) and (*c*), by minimizing the gap between the inlet port and the filter, the bubble can move without limitation to the moving direction, so that the ink jet head mounting position can be determined with larger design latitude which may permit use of a common ink jet head for various ink jet recording apparatuses.

Embodiment 2

FIG. 6 shows a second embodiment of the filter. In this Figure, the same reference numerals as in the first embodiment are assigned for the elements having the corresponding functions, and the detailed descriptions thereof are omitted for simplicity. FIG. 6, (*a*) is a sectional view when the ink ejecting direction of the ink jet head is coaxial with the direction of the gravity, and FIG. 6, (*b*) is a sectional view when the ink ejecting direction is horizontal crossing with the gravity direction.

In this embodiment, as shown in FIG. 6, (*a*), both of the filter 213 and the internal wall 212 at the ink container 10 side of the filter box 211, are inclined approx. about 40 degrees relative to the horizontal plane.

Therefore, both of the filter and the wall guide the bubbles in addition to the tendency of the upward movement due to the buoyancy of the bubbles 251 as in the foreign embodiment. Even if the bubbles form meniscuses in the filter, the portion where the bubbles are deposited on the filter can be easily changed, as compared with the case that the filter extends horizontally, and therefore, the upward movement of the bubbles at the filter is made more easier, and as a result, the bubbles at the marginal area of the filter box are stabilized.

The bubble moving function is provided irrespective of the pose or inclination, since the filter in the filter box has an angle relative to the horizontal direction, even if the ink jet unit is rotated through 90 degrees to eject the ink in the horizontal direction, as shown in FIG. 6, (*b*).

The angle of the filter in the filter box relative to the horizontal plane is preferably 30–60 degrees to permit motion of the bubbles, but is further preferably 40–50 degrees in consideration of the flow resistance and the effects provided with a plurality of inclinations. In this embodiment, it is approx. 40 degrees.

In this embodiment, the bubbles are promoted to move away from the ink flow along the line connecting the inlet port and the outlet port of the filter box, so that the main component of the ink pressure actable on the bubbles is substantially codirectional with the filter, and therefore, the bubbles are not subjected to such forces as are effective to urge the bubbles to the filters thus remarkably changing the configurations of the bubbles as in the case where the bubbles are at the central portion of the filter.

Therefore, the force acting on the bubbles stagnating at the filter is substantially uniform resulting from the pressure difference across the filter, and therefore, the bubbles can pass through the filter without formation of the fine bubbles. This embodiment is particularly suitable when the direction of the buoyancy of the bubbles are opposite from the main ink supply direction in the filter portion.

Similarly to the foregoing embodiments, the flow of the ink during the sucking process operation upon the container exchange or the like and the recording operation, is not impeded by the filter.

The inlet port functioning as the connecting portion with the filter box 211 in the ink passage extending between the ink container 10 and the filter box 211, is substantially at the central portion of the filter box 211 in this embodiment. This is done in order to provide the effects with a plurality of inclinations including the inclinations shown in FIGS. 6, (*a*) and (*b*).

Figure 6A:
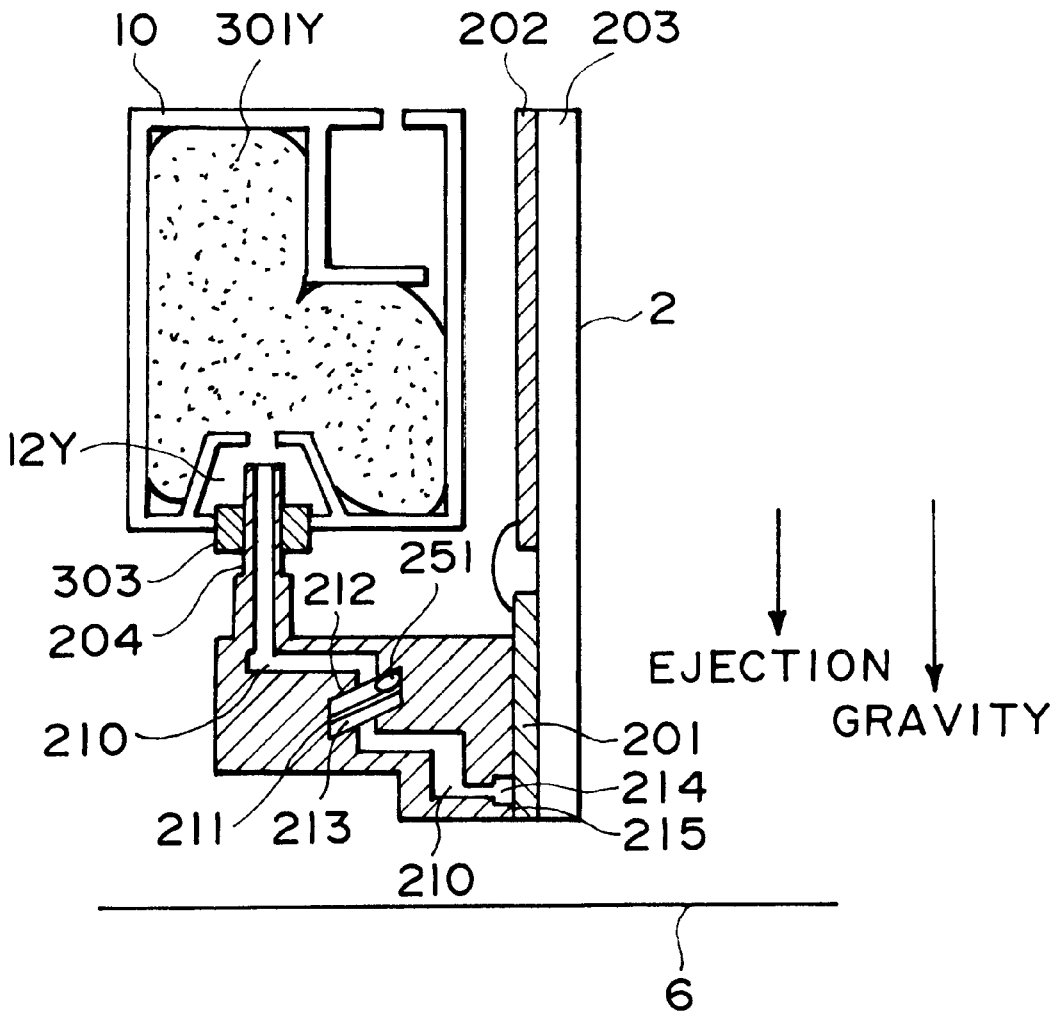
FIG. 6 is a sectional view of an ink supply system from an inside of an ink container to an end of the nozzles of the ink jet head in an ink jet recording apparatus according to a second embodiment of the present invention, in which (a) shows the case in which the ink ejecting direction is substantially parallel with the direction of the gravity, and (b) shows the case in which the ejecting direction is substantially orthogonal to the direction of the gravity.
Figure 6B:
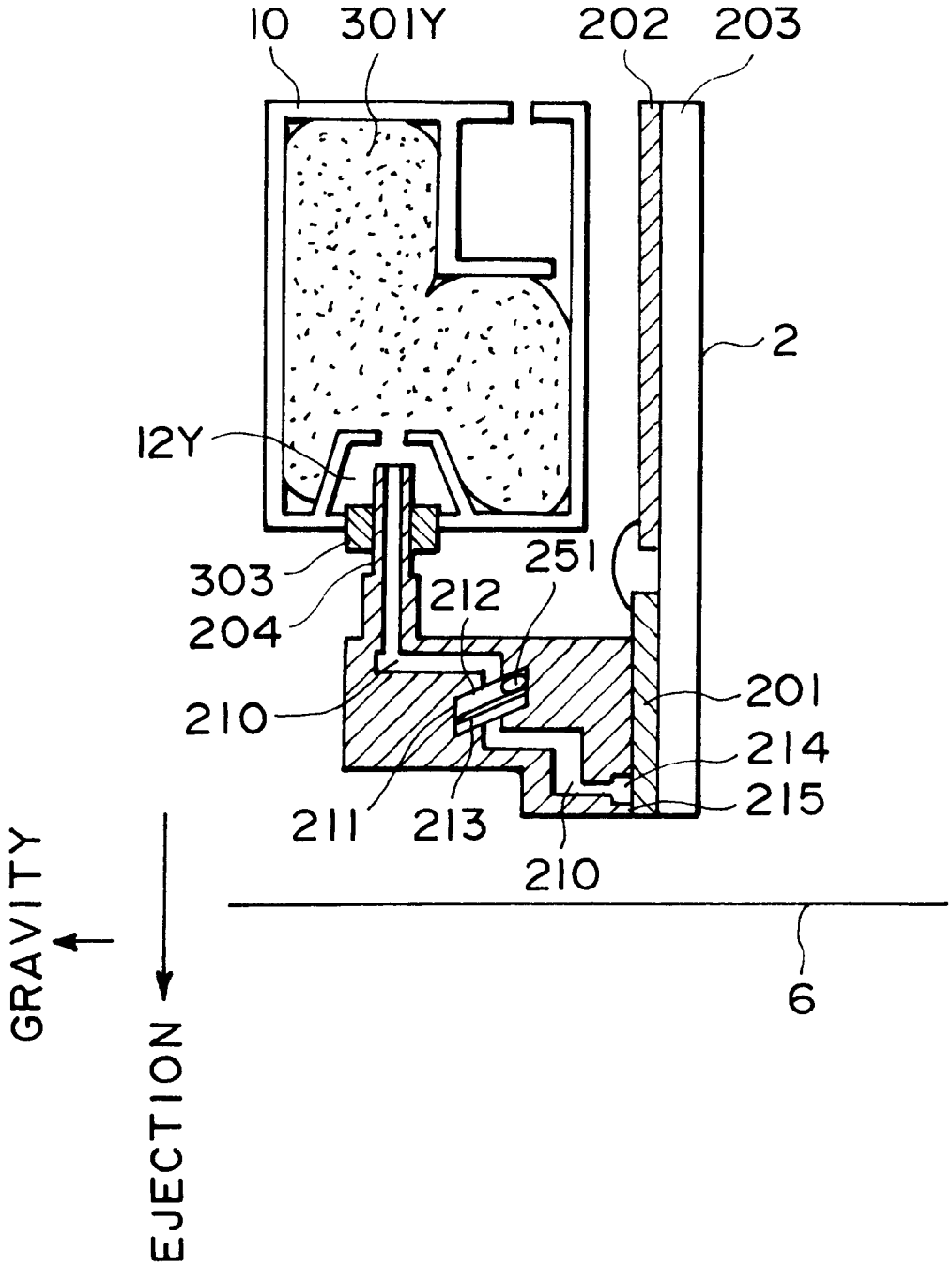
Figure 7:
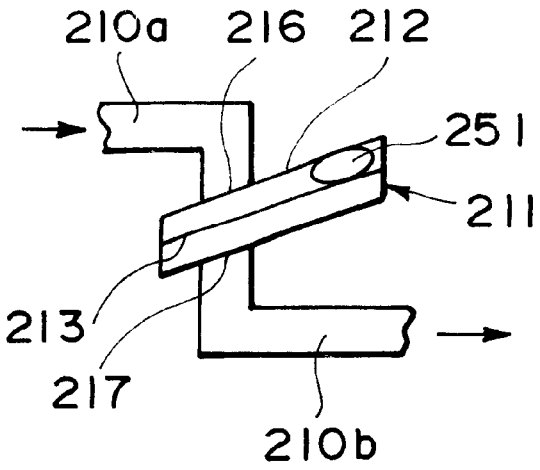
FIG. 7 is an enlarged sectional view of a filter of an ink jet recording apparatus according to a modification of the second embodiment.

If the inclination during use is limited, an opening in fluid communication with the ink supply passage may be formed outside the central area of the filter box. An example thereof is shown in FIG. 7. In FIG. 7, the positions of the opening 216 and 217 is lower on the basis of the gravity direction. With this structure, when the bubbles in the filter box move to the marginal area, the distance from the opening is larger as compared with the foregoing embodiment, and therefore, the variation of the ink supply quantity in the recovery operation is less. When the structure of FIG. 7 is used, the bubble moving function is provided effectively in the case of the positions shown in FIGS. 6, (*a*) and (*b*).

Embodiment 3

Figure 8:
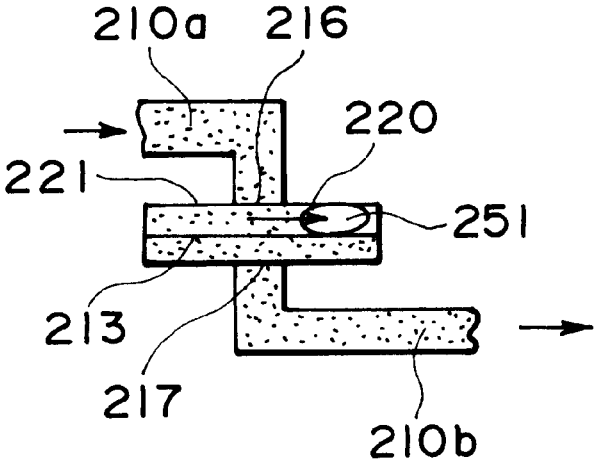
FIG. 8 is an enlarged sectional view of the filter in an ink jet recording apparatus according to a third embodiment of the present invention.

In the third embodiment, a wettability of the internal wall surface of the filter box is changed in order to stabilize the pressure applied on the air bubbles by moving the bubbles 251 away from the inlet port in the filter box. FIG. 8 is a sectional view of the filter box 211 in the ink jet recording apparatus. Here, the wettability of the inner wall surface 221 is higher than that in the internal wall surface 220. In order to change the wettability, a water repelling material is applied on the internal wall surface 220, by which the advancing contact angle is changed from 50 degrees to approx. 80 degrees. Preferably, the contact angle is not less than 90 degrees. The internal wall surface 221 may be subjected to hydrophilic treatment such as corona discharging treatment or plasma ashing treatment or the like. When the bubbles at the filter are enlarged to a certain degree, the ink tends to move from the internal wall surface 220 to the wall surface 221 having higher wettability along the internal wall having the inlet port 216 in fluid communication with the ink container 10 side of the filter box 211, and therefore, the bubbles 251 move along the internal wall 220.

Bubble moving means in this embodiment is in the form of the different surface treatment of the internal wall surface. Only with the surface treatment, the influence of the carriage scanning movement during the recording operation is significant although it is possible to move the ink to the marginal area. Therefore, it is preferable to combine this embodiment with one or more of the foregoing embodiments to promote the motion of the bubbles.

When the wettability adjacent the inlet opening is improved by the combination with the surface treatment, the motions of the bubbles from the inlet port of the filter box, is irreversible.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is applicable to an ink jet apparatus using piezoelectric elements for ejecting the ink without use of the electrothermal transducers.

As will be understood from the foregoing, according to the present invention, the ink supply is not impeded but is stabilized even if the bubbles are in the filter box, and in addition, the sucking recovery operation can be carried out without producing fine bubbles.

Additionally, the ink jet recording apparatus which can enjoy the above advantageous effects irrespective of the mounting pose or inclination of the ink jet head, can be provided. Accordingly, the ink jet head can be made common for different ink jet recording apparatus for different usage. Therefore, the cost can be reduced.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head for ejecting an ink, comprising:

an ink passage for supplying the ink from an ink container; and a filter chamber disposed in said ink passage, said filter chamber containing therein a filter, wherein said filter chamber has a cross-sectional area larger than that of said ink passage and is provided with an inlet opening in fluid communication with an inlet part of said ink passage for supplying the ink from said ink container to said filter chamber and an outlet opening in fluid communication with an outlet part of said ink passage for supplying the ink out of said filter chamber, said inlet opening and said outlet opening are faced to the filter with a clearance, and a clearance between an inlet side internal wall and an inlet side of said filter adjacent said inlet opening is smaller than a clearance between an inlet side internal wall and an inlet side of said filter elsewhere.

2. An ink jet head according to claim 1, wherein said ink jet head comprises an electrothermal transducer element for ejecting the ink.

3. An ink jet head according to claim 1, wherein said chamber is provided with a recess in an internal wall surface of said chamber at the inlet side of the filter.

4. An ink jet head according to claim 1, wherein said filter chamber has an internal wall surface with a portion having a better wettability adjacent to the inlet opening than a portion away therefrom.

5. An ink jet head for ejecting ink, comprising:

an ink passage for supplying ink from an ink container; and a filter chamber in said ink passage, said filter chamber including a flat filter therein, wherein said filter chamber has a cross-sectional area larger than that of said ink passage and is provided with an inlet opening in fluid communication with an inlet part of said ink passage for supplying the ink from said ink container to said filter chamber and an outlet opening in fluid communication with an outlet part of said ink passage for supplying the ink out of said filter chamber, said inlet opening and said outlet opening are faced to said filter, and an internal wall surface of said filter chamber and said filter are inclined relative to a horizontal plane and to a vertical plane.

6. An ink jet head according to claim 5, wherein said chamber is provided with a recess in an internal wall surface of said chamber at the inlet side of the filter.

7. An ink jet head according to claim 5, wherein said filter chamber has an internal wall surface with a portion having a better wettability adjacent the inlet opening than a portion away therefrom.

8. An ink jet head according to claim 5, wherein the bubble is moved to a position where a pressure of the ink is relatively small due to the inclination of said filter.

9. An ink jet head according to claim 5, wherein said filter is inclined by 30 to 60 degrees relative to the horizontal plane.

10. An ink jet recording apparatus comprising:

an ink jet head for ejecting ink;

an ink passage for supplying ink from an ink container; and a filter chamber in said ink passage, said filter chamber including a flat filter therein, wherein said filter chamber has a cross-sectional area larger than that of said ink passage and is provided with an inlet opening in fluid communication with an inlet part of said ink passage for supplying the ink from said ink container to said filter chamber and an outlet opening in fluid communication with an outlet part of said ink passage for supplying the ink out of said filter chamber, said inlet opening and said outlet opening are faced to said filter, and an internal wall surface of said filter chamber and said filter are inclined relative to a horizontal plane and to a vertical plane.

11. An ink jet recording apparatus according to claim 10, wherein said filter chamber is provided with a recess in an internal wall surface of said chamber at the inlet side of the filter, so that a clearance between said filter and an internal wall of said filter chamber is smallest at a portion of the internal wall adjacent the inlet opening.

12. An ink jet recording apparatus according to claim 10, wherein said chamber has an internal wall surface with a portion having a better wettability adjacent the inlet opening than a portion away therefrom.

13. An ink jet recording apparatus according to claim 12, wherein said filter chamber is provided with a recess in an internal wall surface of said chamber at the inlet side of the filter, so that a clearance between said smalllest at a portion of the internal wall adjacent the inlet opening.

14. An ink jet recording apparatus according to claim 12, wherein said chamber has an internal wall surface with a portion having a better wettability adjacent the inlet opening than a portion away therefrom.

15. An ink jet head for ejecting ink comprising:

an ink passage having a flat filter for supplying ink from an ink container; and an ink ejecting portion for ejecting the ink;

wherein the ink flows substantially vertically adjacent said filter in said ink passage, and the ink flows in a direction from a top side to a bottom side of said filter, wherein said flat filter is inclined by 30 to 60 degrees relative to a horizontal plane.

16. An ink jet head according to claim 15, wherein the bubble is moved to a position where pressure is relatively small due to the inclination of said filter.

17. An ink jet recording apparatus comprising:

an ink jet head for ejecting an ink; and an ink passage having a flat filter for supplying the ink from an ink container, wherein the ink flows substantially vertically adjacent said filter in said ink passage, and the ink flows in a direction from a top side to a bottom side of said filter, wherein said flat filter is inclined by 30 to 60 degrees relative to a horizontal plane.

18. An ink jet recording apparatus comprising:

an ink jet head for ejecting an ink; and an ink passage having a flat filter for supplying the ink from an ink container;

negative pressure generating means for spacing the bubble from said filter, wherein the ink flows substantially vertically adjacent said filter in said ink passage, and the ink flows in a direction from a top side to a bottom side of said filter, and said flat filter is inclined relative to a horizontal plane, and to a vertical plane.

* * * * *

UNITED STATES PATENT AND TRADEMARK OFFICE

CERTIFICATE OF CORRECTION

PATENT NO. : 6,158,855
DATED : December 12, 2000
INVENTOR(S) : Hideo Saikawa

It is certified that error appears in the above-identified patent and that said Letters Patent is hereby corrected as shown below:

Title page,
Item [56], References Cited, U.S. PATENT DOCUMENTS,
-- 5,280,299 1/1994 Saikawa et al. -- should be inserted.

Column 1,
Line 47, “is” should read -- are --;
Line 50, “solved” should read -- dissolved --;
Line 52, “clogs” should read -- clog --; and
Line 62, “or pose” should be deleted.

Column 2,
Line 22, “differences” should read -- difference --.

Column 3,
Line 18, “poses.” should read -- positions. --;
Line 49, “horizontal,” should read -- horizontal --; and
Line 66, “moves” should read -- move --.

Figure 3A:
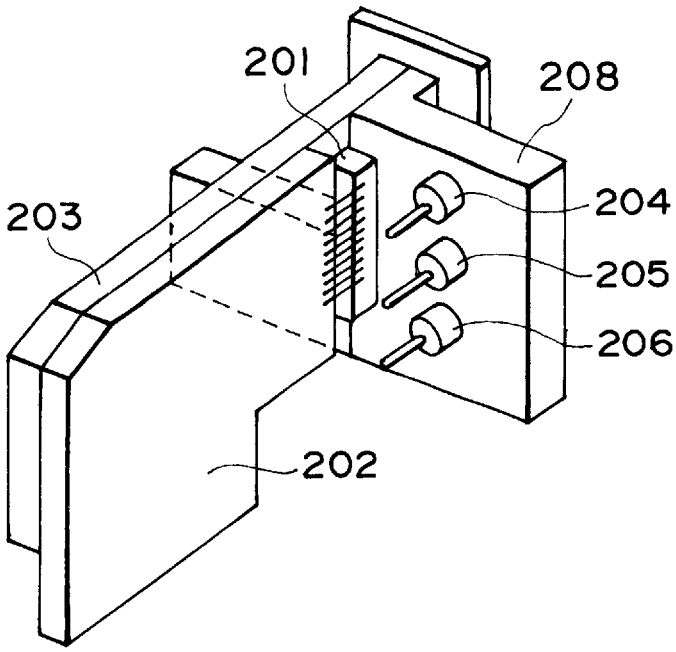
FIG. 3 is perspective views of an ink jet head to which the present invention is applicable, and (a) is a perspective view as seen from an ink inlet side of the ink jet head, and (b) is a perspective view as seen from a nozzle side.
Figure 3B:
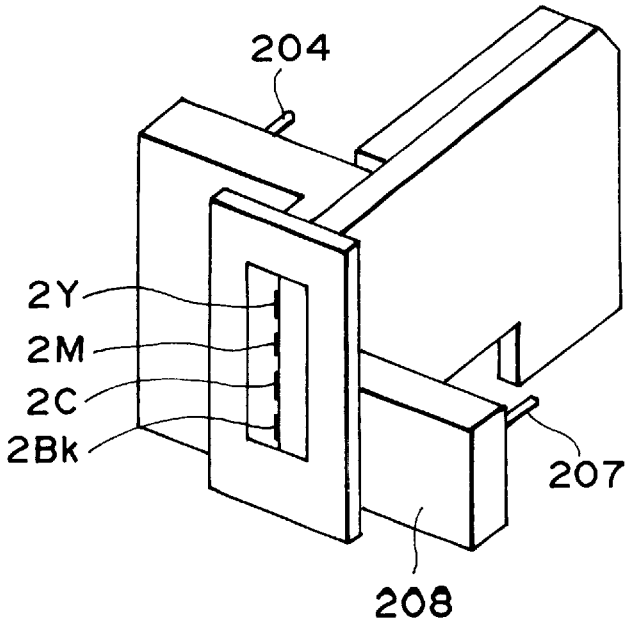
Figure 5A:
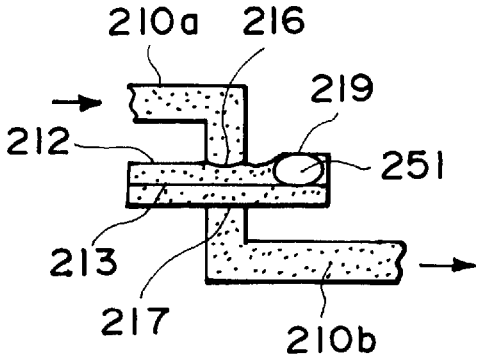
FIG. 5 is enlarged sectional views adjacent a filter of the ink jet recording apparatus according to the first embodiment, wherein various configurations of a filter box are shown.
Figure 5B:
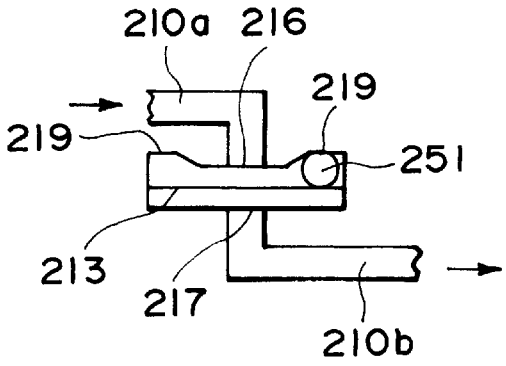
Figure 5C:
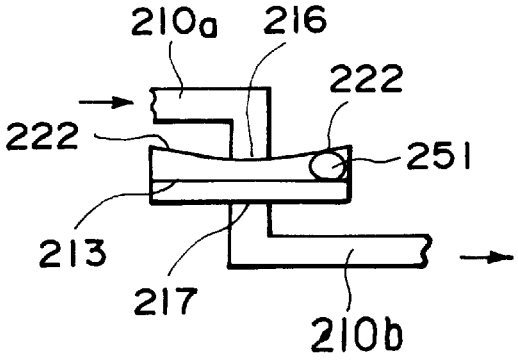

Column 4,
Line 2, “obstruct” should read -- obstruction --;
Line 26, “FIG. 3 is” should read -- Figures 3A and 3B are --;
Line 27, “(a)” should read -- 3A --;
Line 28, “(b)” should read -- 3B --;
Line 35, “FIG. 5 is” should read -- Figures 5A to 5C are --;
Line 39, “FIG. 6 is a sectional view” should read -- Figures 6A and 6B are both sectional views --;
Line 42, “(a)” should read -- 6A --; and
Line 44, “(b)” should read -- 6B --.

Column 5,
Line 6, “screws” should read -- screw --; and
Line 8, “translate” should read -- translates --.

UNITED STATES PATENT AND TRADEMARK OFFICE

CERTIFICATE OF CORRECTION

PATENT NO. : 6,158,855
DATED : December 12, 2000
INVENTOR(S) : Hideo Saikawa

It is certified that error appears in the above-identified patent and that said Letters Patent is hereby corrected as shown below:

Column 6,
Line 16, “at and” should read -- at the end --
Line 22, “Supply unit 208 needle” should read -- supply unit 208 penetrates the ink container 10”
Line 49, “through” should be deleted; and
Line 51, “solved” should read -- dissolved --.

Column 7,
Line 43, “pending” should read -- tending --;
Line 44, “light” should be deleted; and
Line 63, “function” should read -- functions --.

Column 8,
Line 55, “foreign” should read -- first --;
Line 60, “more” should be deleted.

Column 9,
Line 20, “are” should read -- is --.

Column 12,
Line 27, claims 13 and 14 should read:

-- 13. An ink jet recording apparatus, comprising:

an ink jet head for ejecting an ink;

an ink passage for supplying the ink from an ink container; and a filter chamber disposed in said ink passage, said filter chamber containing therein a filter, wherein said filter chamber has a cross-sectional area larger than that of said ink passage and is provided with an inlet opening in fluid communication with an inlet part of said ink passage for supplying the ink from said ink container to said filter chamber and an outlet opening in fluid communication with an outlet part of said ink passage for supplying the ink out of said filter chamber, wherein said inlet opening and said outlet opening are faced to the filter with a clearance, and a clearance between an inlet side internal wall and an inlet internal side of said filter adjacent to said inlet opening is smaller than a clearance between an inlet side internal wall and an inlet side of said filter elsewhere. --

UNITED STATES PATENT AND TRADEMARK OFFICE

CERTIFICATE OF CORRECTION

PATENT NO. : 6,158,855
DATED : December 12, 2000
INVENTOR(S) : Hideo Saikawa

It is certified that error appears in the above-identified patent and that said Letters Patent is hereby corrected as shown below:

Column 12 (cont'd),

-- 14. An ink jet recording apparatus according to Claim 13, wherein said ink jet head comprises an electro-thermal transducer element for ejecting the ink. --

Signed and Sealed this

Twenty-third Day of September, 2003

JAMES E. ROGAN
*Director of the United States Patent and Trademark Office*